US006212685B1

(12) United States Patent
Kelly

(10) Patent No.: US 6,212,685 B1
(45) **Date of Patent: *Apr. 10, 2001**

(54) SHIRT CUFF AND FASTENER

(76) Inventor: Jim E. Kelly, 2274 W. 21st St., Los Angeles, CA (US) 90018

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/116,133

(22) Filed: Jul. 14, 1998

(51) Int. Cl.[7] ..... A41B 7/02
(52) U.S. Cl. ..... 2/123; 2/270
(58) Field of Search ..... 2/123, 124, 59, 2/60, 162, 270, 269, 125; 24/15, 41.1, 42, 43, 44, 45, 46, 47, 48, 90.1, 93, 97, 99, 102 R, 102 E, 102 FC, 102 SL, 114.9, 114.11; 63/18, 23; D11/200, 213, 222, 226, 228; D2/858

(56) References Cited

U.S. PATENT DOCUMENTS

| | | | |
|---|---|---|---|
| 12,899 | * | 5/1855 | Chandler . |
| 56,737 | * | 7/1866 | Evans . |
| 145,957 | * | 12/1873 | Mack . |
| D. 154,048 | | 6/1949 | Le Vaggi . |
| D. 167,845 | * | 9/1952 | Napolitani . |
| 176,185 | * | 4/1876 | Levy et al. . |
| D. 193,760 | | 10/1962 | Sanders . |
| 208,817 | * | 10/1878 | Hedges et al. . |
| 252,277 | * | 1/1882 | Turner . |
| D. 265,145 | * | 6/1982 | Piorek . |
| D. 312,985 | * | 12/1990 | Sprick . |
| 324,184 | * | 8/1885 | Stuart et al. . |
| D. 335,106 | * | 4/1993 | Teeter . |
| 344,313 | * | 6/1886 | Gutmann . |
| D. 355,396 | * | 2/1995 | Andrau . |
| 365,894 | * | 7/1887 | Zoller . |
| D. 366,013 | * | 1/1996 | Pandel . |
| D. 379,603 | * | 6/1997 | Sprick . |
| D. 396,660 | * | 8/1998 | Ricci . |
| 701,445 | * | 6/1902 | Wood . |
| 1,140,685 | | 5/1915 | Kaminkowitz . |
| 1,263,446 | * | 4/1918 | Logan . |
| 1,426,892 | | 8/1922 | McCoy . |
| 1,691,958 | * | 11/1928 | Bostick ..... 2/123 |
| 2,101,493 | | 12/1937 | Crain . |
| 2,225,889 | * | 12/1940 | Rubenstein . |
| 2,637,083 | * | 5/1953 | Plotnizky . |
| 2,785,410 | | 3/1957 | Wagar . |
| 2,876,456 | | 2/1959 | Johnson . |
| 2,879,571 | * | 3/1959 | Martinez . |
| 4,052,771 | * | 10/1977 | Cole . |

FOREIGN PATENT DOCUMENTS

| | | | |
|---|---|---|---|
| 345566 | * | 12/1904 | (FR) ..... 2/123 |
| 473014 | | 12/1914 | (FR) . |
| 293653 | * | 7/1928 | (GB) ..... 2/123 |

* cited by examiner

*Primary Examiner*—Amy B. Vanatta
(74) *Attorney, Agent, or Firm*—Blakely, Sokoloff, Taylor & Zafman LLP

(57) ABSTRACT

A shirt cuff comprises a band of material having first and second opposing edges and first and second opposing ends. The first edge is attached to the sleeve of the shirt. The dimensions of the band are such that it substantially closes about the circumference of the sleeve along the first edge. Unlike conventional cuffs, the two ends of the band diverge from the first edge toward the second edge such that the two ends are substantially separated proximate to the second edge. In one embodiment, the edges are substantially straight so that there is a "V"-shaped opening in the cuff. In other embodiments, the ends of the band may have alternative shapes, but in each case there is a substantial opening in the cuff proximate to the second edge of the band. A fastener for the cuff connects the two ends of the band, spanning the opening therebetween.

6 Claims, 2 Drawing Sheets

FIG. 1
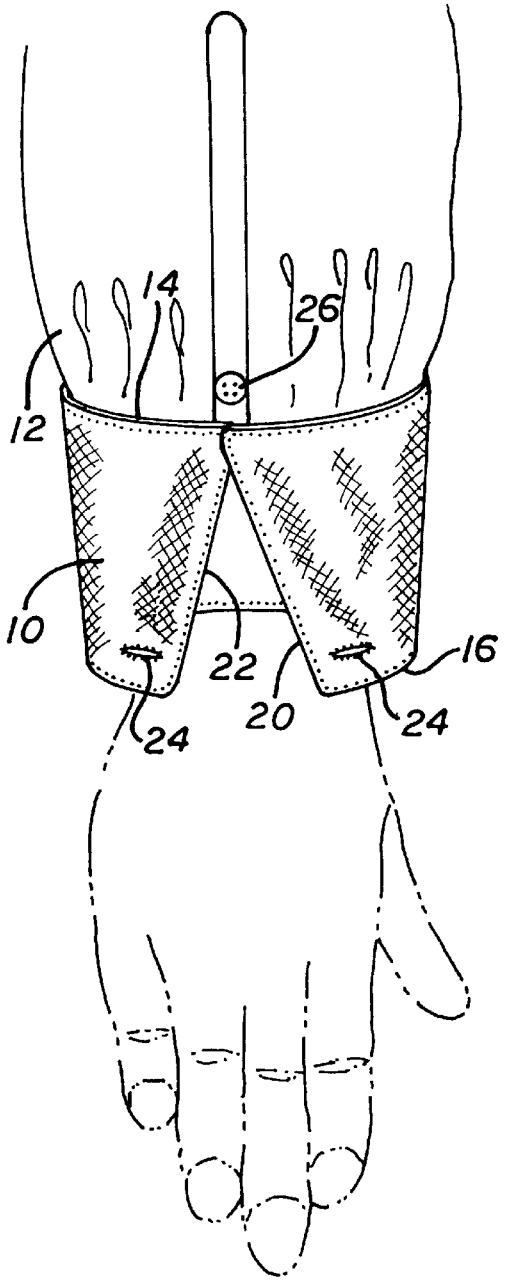
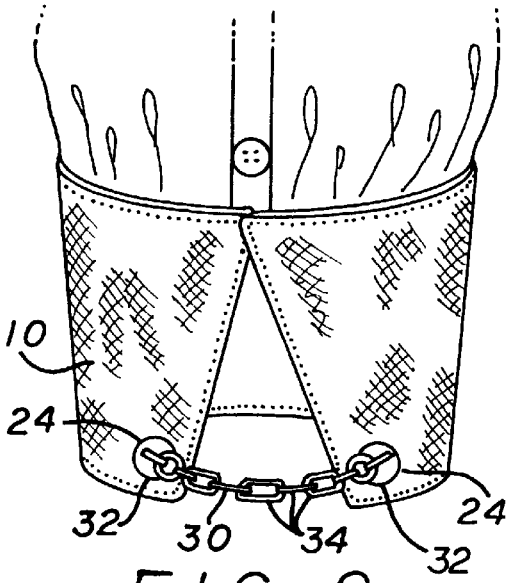
FIG. 2
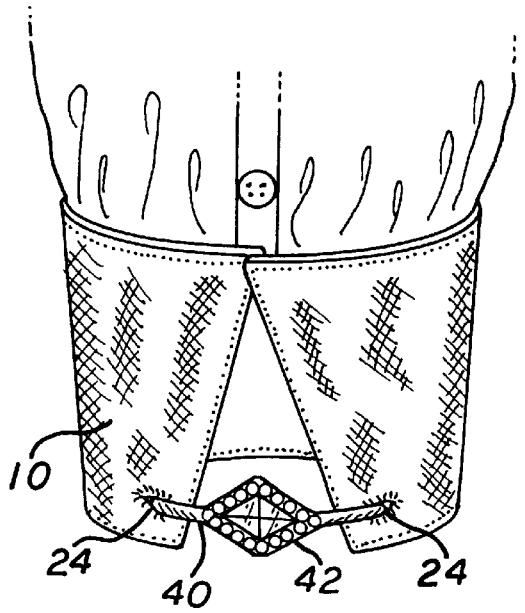
FIG. 3

SHIRT CUFF AND FASTENER

BACKGROUND OF THE INVENTION

1. Field of the Invention

The present invention relates generally to the field of wearing apparel and, more particularly, to a novel shirt cuff and fastener therefor.

2. Prior Art

Shirt cuffs are conventionally offered in two styles: one in which the cuff ends overlap and are fastened by a button and the "French cuff" which is typically fastened with a cuff link. Some cuffs of the former type are made to be "convertible" so that, if desired, they may be fastened with a cuff link instead of a button. All conventional shirt cuffs fully encircle the wrist of the wearer so that they may be fastened with either a button or conventional cuff link.

Conventional shirt cuffs and cuff links have a uniformity of appearance that many regard as banal. There is a perceived need, particularly among style-conscious individuals for a fresh look in shirt cuffs and fasteners.

SUMMARY OF THE INVENTION

The present invention provides a shirt cuff of novel construction together with a fastener therefor. In general terms, the shirt cuff comprises a band of material having first and second opposing edges and first and second opposing ends. The first edge is attached to the sleeve of the shirt. The dimensions of the band are such that it substantially closes about the circumference of the sleeve along the first edge. Unlike conventional cuffs, the two ends of the band diverge from the first edge toward the second edge such that the two ends are substantially separated proximate to the second edge. In one embodiment, the edges are substantially straight so that there is a "V"-shaped opening in the cuff. In other embodiments, the ends of the band may have alternative shapes, but in each case there is a substantial opening in the cuff proximate to the second edge of the band. A fastener for the cuff connects the two ends of the band, spanning the opening therebetween.

BRIEF DESCRIPTION OF THE DRAWINGS

FIG. 1 is a perspective view of a shirt cuff constructed in accordance with the present invention.

FIG. 2 illustrates a first type of closure device for the cuff of FIG. 1.

FIG. 3 illustrates a second type of closure device for the cuff of FIG. 1.

DETAILED DESCRIPTION OF THE INVENTION

Figure 4:
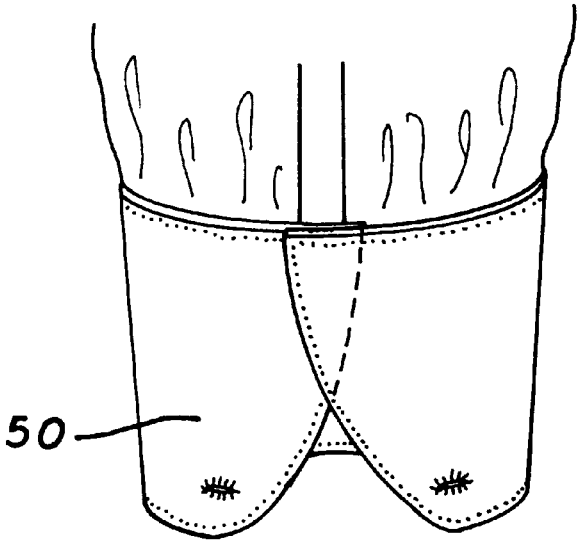
FIG. 4 illustrates an alternative style of shirt cuff.

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

An exemplary embodiment of the present invention is illustrated in FIG. 1. A cuff 10 is sewn to the end of a shirt sleeve 12 in a conventional manner. Cuff 10 is defined by edge 14, which is joined to sleeve 12, and opposing edge 16. Cuff 10 is further defined by opposing ends 20 and 22. When worn around the wrist of an individual, cuff ends 20 and 22 diverge from edge 14 in the direction of edge 16 to form a generally "V"-shaped opening at the wrist. It will be appreciated that, if cuff 10 were laid flat, the cuff would have a generally trapezoidal shape. A pair of apertures 24 are located on cuff 10 proximate to edge 16 and to cuff ends 20 and 22, respectively. The function of apertures 24 will be more fully described below. Optionally, a closure such as button 26 may be provided on cuff 10 or sleeve 12 proximate to cuff edge 14 to maintain closure of the cuff along edge 14 with cuff ends 20 and 22 proximate to one another or slightly overlapping.

Referring now to FIG. 2, cuff 10 is illustrated with closure device 30 inserted through apertures 24. Closure device 30 comprises a chain of individual links 34 so that it drapes across the opening between the cuff ends 20 and 22. Apertures 24 may be slit-shaped in the manner of conventional button holes or may be small round holes similar to those used for certain types of collar closures. The size and shape of apertures 24 will, of course, correspond to the construction of closure device 30. In this regard, each end of closure device 30 may have button-shaped projections 32, in which case apertures 24 are preferably slit-shaped. Alternatively, closure device 30 may have pin-shaped studs at each end, in which case apertures 24 are preferably small, round holes.

Closure device 30 is intended to be a decorative piece of jewelry that is visible when worn by an individual. Therefore, cuff 10 is preferably positioned on sleeve 12 so that the opening between cuff ends 20 and 22 will fall to the outside of the individual's wrists when the individual's arms are in a relaxed position at the individual's sides. This is in contrast to most conventional cuff designs wherein the cuff opening typically faces to the rear when the individual's arms are in a relaxed position at the individual's sides.

FIG. 3 illustrates cuff 10 with an alternative closure device 40. This device is of rigid unitary construction and may incorporate decorative elements, such as gem stone 42.

Figure 5:
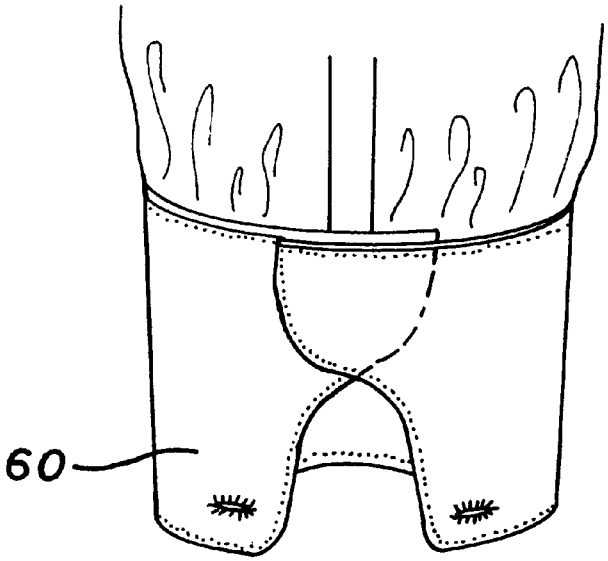
FIG. 5 illustrates another alternative style of shirt cuff.

Cuff 10 is illustrated with substantially straight opposing ends 20 and 22; however, the cuff ends may have various alternative shapes. For example, FIG. 4 illustrates a cuff 50 in which the cuff ends are curved. FIG. 5 illustrates a cuff end 60 with compound curved cuff ends. In each case, the cuff ends diverge from the cuff edge which is sewn to the shirt sleeve in a direction towards the outer edge of the cuff so that a closure device may be advantageously displayed between the cuff ends. The cuff ends themselves may be plain as illustrated or may include decorative appliques, piping or the like.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A garment for the upper-body of a wearer comprising:

a body portion;

a pair of sleeves attached to the body portion;

a pair of cuffs, each of said pair of cuffs sewn to a respective one of the pair of sleeves, each of said pair of cuffs comprising a band of material having first and second opposing edges and first and second opposing ends, said first edge sewn to the sleeve, said band substantially closing about a circumference of the sleeve along said first edge, said first and second ends diverging from said first edge toward said second edge such that said first and second ends are substantially separated proximate to said second edge defining an opening therebetween, wherein each of the pair of cuffs is positioned on its respective sleeve so that the opening between the first and second ends falls to the outside of the wearer's wrists above the back of the weaver's hand relaxed position at the wearer's sides, and, wherein each of the bands of material includes first and second apertures therethrough proximate to the first and second ends, respectively, and both first and second apertures are proximate to the second edge;

a closure device comprising a decorative piece of jewelry for each of the pair of cuffs having first and second ends inserted through the first and second apertures, respectively, each of said first and second ends comprising a generally button-shaped projection disposed to an interior of the cuff, said closure further comprising a spanning portion connecting the first and second ends disposed to an exterior of the cuff.

2. The garment of claim 1 wherein the first and second ends of each of the pair of cuffs are substantially straight.

3. The garment of claim 2 wherein the first and second ends of each of the pair of cuffs form respective oblique angles with respect to the second edge.

4. The garment of claim 1 wherein the first and second ends of each of the pair of cuffs are curved.

5. The garment of claim 1 wherein the spanning portion of the closure comprises a plurality of links.

6. The garment of claim 1 wherein the spanning portion of the closure includes a gem stone.

* * * * *

UNITED STATES PATENT AND TRADEMARK OFFICE

CERTIFICATE OF CORRECTION

PATENT NO. : 6,212,685 B1
DATED : April 10, 2001
INVENTOR(S) : Kelly

It is certified that error appears in the above-identified patent and that said Letters Patent is hereby corrected as shown below:

Column 3,
Line 8, delete “weaver’s and insert -- wearer’s --.
Line 9, before “relaxed position” insert -- when the wearer’s arms are in a --.

Signed and Sealed this

Sixth Day of August, 2002

*Attest:*

*Attesting Officer*

JAMES E. ROGAN
*Director of the United States Patent and Trademark Office*